US010058887B2

(12) United States Patent
Alvarez Bonilla

(10) Patent No.: US 10,058,887 B2
(45) Date of Patent: Aug. 28, 2018

(54) PROCEDURE OF MASONRY AND NOZZLE FOR VISCOUS FLUID INJECTION

(71) Applicant: SIC S.P.A, Santiago (CL)

(72) Inventor: Antonio Alvarez Bonilla, Santiago (CL)

(73) Assignee: SIC S.P.A., Santiago (CL)

( * ) Notice: Subject to any disclaimer, the term of this patent is extended or adjusted under 35 U.S.C. 154(b) by 0 days.

(21) Appl. No.: 15/314,714

(22) PCT Filed: May 29, 2014

(86) PCT No.: PCT/IB2014/061820

§ 371 (c)(1),
(2) Date: Nov. 29, 2016

(87) PCT Pub. No.: WO2015/181582

PCT Pub. Date: Dec. 3, 2015

(65) Prior Publication Data

US 2017/0197230 A1 Jul. 13, 2017

(51) Int. Cl.

| | |
|---|---|
| ***B05B 7/06*** | (2006.01) |
| ***B05C 17/10*** | (2006.01) |
| ***E04F 13/08*** | (2006.01) |
| ***E04F 13/14*** | (2006.01) |
| ***B05C 7/06*** | (2006.01) |
| ***B05C 17/00*** | (2006.01) |

(52) U.S. Cl.
CPC ..... *B05C 17/10* (2013.01); *B05C 7/06* (2013.01); *B05C 17/002* (2013.01); *E04F 13/0891* (2013.01); *E04F 13/14* (2013.01)

(58) Field of Classification Search
CPC ..... B05C 17/10; B05C 7/06; B05C 17/002; E04F 13/0891; E04F 13/14
USPC ..... 239/251, 103
See application file for complete search history.

(56) References Cited

U.S. PATENT DOCUMENTS 4,622,085 A 11/1986 Yamada et al.
4,919,604 A * 4/1990 Wilson ..... A47L 13/08 15/235.7

(Continued)

FOREIGN PATENT DOCUMENTS

| | | |
|---|---|---|
| CL | 42628 | 2/2005 |
| EP | 0299121 | 1/1989 |

OTHER PUBLICATIONS

International Search Report and Written Opinion, International Patent Application No. PCT/IB14/61820, dated Aug. 12, 2015 (12 pages).

*Primary Examiner* — Chee-Chong Lee
(74) *Attorney, Agent, or Firm* — Hamre, Schumann, Mueller & Larson, P.C.

(57) ABSTRACT

The present invention consists in a nozzle for the efficient injection of viscous fluids into holes, cracks or groves through a mechanism preventing the draining outwardly of the volume to fill, which is obtained by incorporating to the injector's tip a screen with a central boring adjusted to the injector tip's surface, preferably of a semi-spherical form and of ferrous material, where said screen shows some freedom of movement levels with respect to the injector, thanks to screen's central boring being surrounded of magnets and having a semi-spherical profile that supplements the injector's tip.

9 Claims, 10 Drawing Sheets

(56) References Cited

U.S. PATENT DOCUMENTS

| | | | | | |
|---|---|---|---|---|---|
| 4,946,077 | A * | 8/1990 | Olsen | F16N 3/12 | 184/105.2 |
| 4,996,799 | A * | 3/1991 | Pound | B24B 15/03 | 451/415 |
| 5,033,197 | A * | 7/1991 | Irvello | B43L 7/02 | 33/27.03 |
| 5,343,982 | A * | 9/1994 | Min | F16N 3/12 | 184/105.2 |
| 5,535,926 | A * | 7/1996 | Blitz | B05C 17/002 | 222/334 |
| 5,695,788 | A * | 12/1997 | Woods | B05C 17/00516 | 15/235.7 |
| 5,882,691 | A | 3/1999 | Conboy | | |
| 6,443,368 | B1 * | 9/2002 | Kohls | B05B 1/28 | 239/288 |
| 2013/0149443 | A1 | 6/2013 | Piedmont | | |

* cited by examiner

PROCEDURE OF MASONRY AND NOZZLE FOR VISCOUS FLUID INJECTION

FIELD OF APPLICATION

The present invention consists in a tool and an associated method. The tool is a nozzle to inject viscous fluids in holes, cracks and grooves, and the method considers the construction of any masonry configuration, preferably walls of brick, initially using only bricks and connectors or separators, as those considered in the Chilean patent of the same inventor No. 42,628, and once the walls have been constructed, injecting the sticking mortar among the masonry units using the nozzle for the injection of viscous fluids, which main characteristics is to prevent the backwards (reverse) draining, i.e. outside of the volume to be filled. The preferred field of application of the nozzle and the associated method is construction in general and, more specifically, masonry,

BACKGROUND

There is at present a great number of nozzles for the projection and/or injection of any kind of fluids, gases, liquids or mixtures thereof. The main differences relate to the form and size, which characteristics are in turn associated with the properties of the fluid and the necessary volume of flow. The purpose of most devices incorporated into the nozzles is to regulate and/or interrupt the flow, while the objective of others is to properly regulating the mixture in the case of compound fluids.

In the case of projecting viscous fluids, in addition to the pump in charge of causing draining, pressurized air is incorporated into the nozzle, with said nozzle generally being a straight extension of the hose or flexible pipe where the air duct couples in addition to the flow regulating devices and those devices in charge of adjusting the mixture.

Mortars are one of the viscous fluids pumped and projected, mainly to apply stucco, i.e. to provide smooth coating to walls, ceilings and even floors. This procedure is performed with a machine in charge of mixing the mortar—that has been pre-dosed dry—with water and then pumping it through flexible pipe, to which end a nozzle is coupled, which is basically a straight extension of the hose to which another pipe is connected to inject pressurized air. The result is that the mortar is projected to the surface one would like to coat.

An example of a nozzle for injection can be found in the European patent EP 199121 of 1989, entitled "Fluid Injection Apparatus", where a piston is described that slides within a cylindrical casing to force a fluid provided in a container through the nozzle. The piston is forced with a spring for an automatic discharge with the action being withheld by a spring through a projection coupling in the piston rod.

Technical Problem

If instead of projecting the mortar over a surface, you would like to inject it in any hole, crack or groove between bricks, eliminating the air injection is enough, so that the fluid comes out from the nozzle continuously and allowing to filling in the volume desired again. Notwithstanding, when the depth of the recess or crack is significantly greater than its width, the following problem arises: before the fluid may fully penetrate, it starts to drain outwardly the space to fill. This occurs in all situations where the force of gravity does not favor the fluid draining to the inside of the volume to fill. It is clear that in each particular case there is a viscosity, fluidity or workability, as in the case of mortar, that reduces the problem described above, but it does not prevent the draining outwardly the cavity to fill.

This technical problem prevents the construction of masonry walls or houses only with bricks and separators, such as those mentioned in the Chilean patent No. 42,628 to inject the ex post mortar; therefore, the need arises to solve these issues, i.e. to get an effective and efficient form of injecting the sticking mortar among the masonry units.

In situations where gravity favors draining inwardly the volume to complete, as in the case of repairing cracks in the floor, the viscosity of the products with which repair is made does not allow its draining the depth of the cracks.

Technical Solution

The present invention consists in a nozzle for the injection of viscous fluids in holes, cracks or grooves, comprising a screen hanging on the tip of the injector to prevent the draining outwardly the volume to fill. The tip of the injector should slightly break through the screen and thus to act as guide for the displacement of the nozzle through the grooves. This solves the problem described above and makes the masonry method feasible that consists in assembling walls only with bricks and separators and then injecting the sticking mortar through an injection assembly comprising a machine to pump the mortar and the nozzle already described in general.

Said method is thought to be especially used combined with the Chilean Invention patent No. 42,628, entitled "Separator of bricks or hollow blocks". This consists in incorporating a pair of connectors in each brick, thus turning into a mecano part; this makes it possible lifting the full wall only with bricks and connectors (separators). In addition, the whole level of a house can be built in this way and then the sticking mortar be injected with a mortar-pumping machine and a system of nozzle as already described, which allows proper penetration of the mortar, both among the different rows of bricks and among the bricks themselves. The invention, however, does not limit to the use of separators described in the Chilean Patent of Invention No. 42,628, but to any other element allowing a similar functionality and technical effect.

In addition to the application described above, the system of nozzle allows proper penetration in the cracks of the fluids used to repair them, or the injection of any viscous fluid in cracks or grooves where depth is significantly greater than its width and where—due to the properties of the fluid—introducing a nozzle is not possible to deposit the filling material properly in the volume to complete.

Technical Advantages

The nozzle of the present invention allows injecting viscous fluids in holes, cracks or grooves in an effective, efficient way without draining outside the volume to fill. This allows using an injection system with the nozzle of the present invention to fill holes, cracks or grooves with viscous fluids, such as mortar, that are deeper than those possible to fill with injection systems of the prior art.

The present invention makes it possible a faster, more economic constructive method of brick masonry allowing to building each level of a house in one run and only with bricks and connectors, installing the door and window frames, water, heating, gas, electricity pipes and its artifacts, and then checking the right placement of all these elements, injecting the sticking mortar of bricks in the openings among them, using a mortar pumping machine and the nozzle of the present invention. Since this new constructive method is faster and more economic, it allows replacing construction methods of lower quality with brick masonry, thus benefitting the final user with safer and more comfortable houses at a lower price.

DETAILED DESCRIPTION OF THE INVENTION

Figure 1:
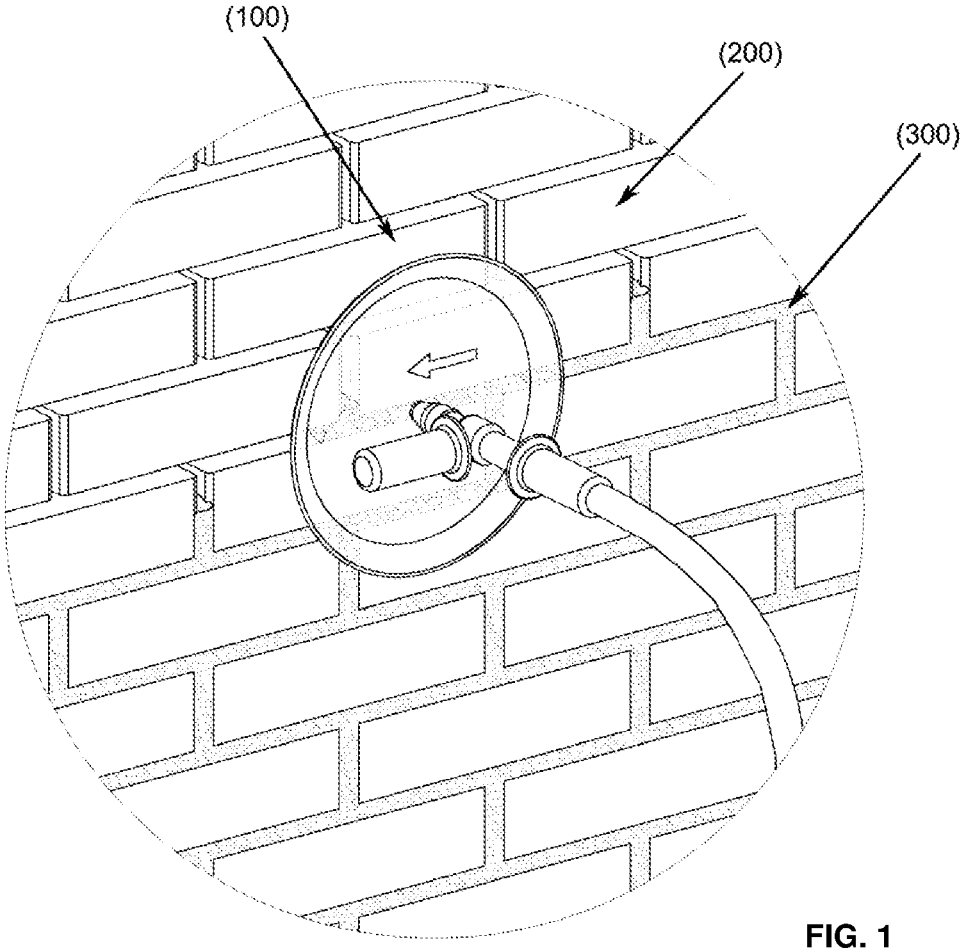
FIG. 1 is a detailed view of a masonry wall built under the method of the present invention in the stage of injecting the sticking mortar, using the nozzle of the present invention according to a preferred embodiment thereof.
Figure 9:
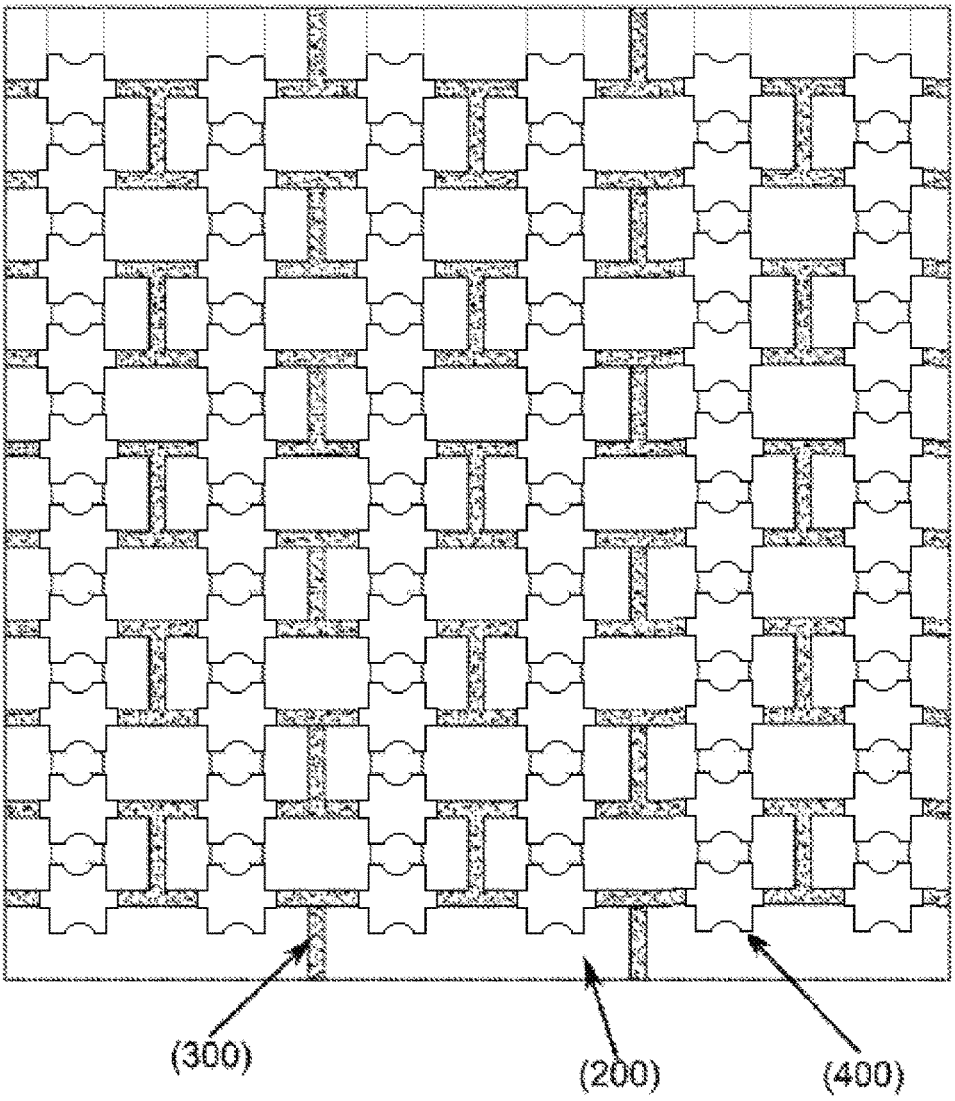
FIG. 9 is a cross-section view of a masonry wall built with separators.

As it can be seen in FIG. 1, the present invention consists in a nozzle (100) for the injection of viscous fluids in holes, cracks or grooves, and a method associated with the construction and/or repair of walls. The FIG. 1 shows how said nozzle (100) is used, especially in the injection of sticking mortar (300) between bricks (200) in a pre-built wall only with bricks (200) and separators (400), the latter as seen in FIG. 9 according to an embodiment of the invention.

Figure 2:
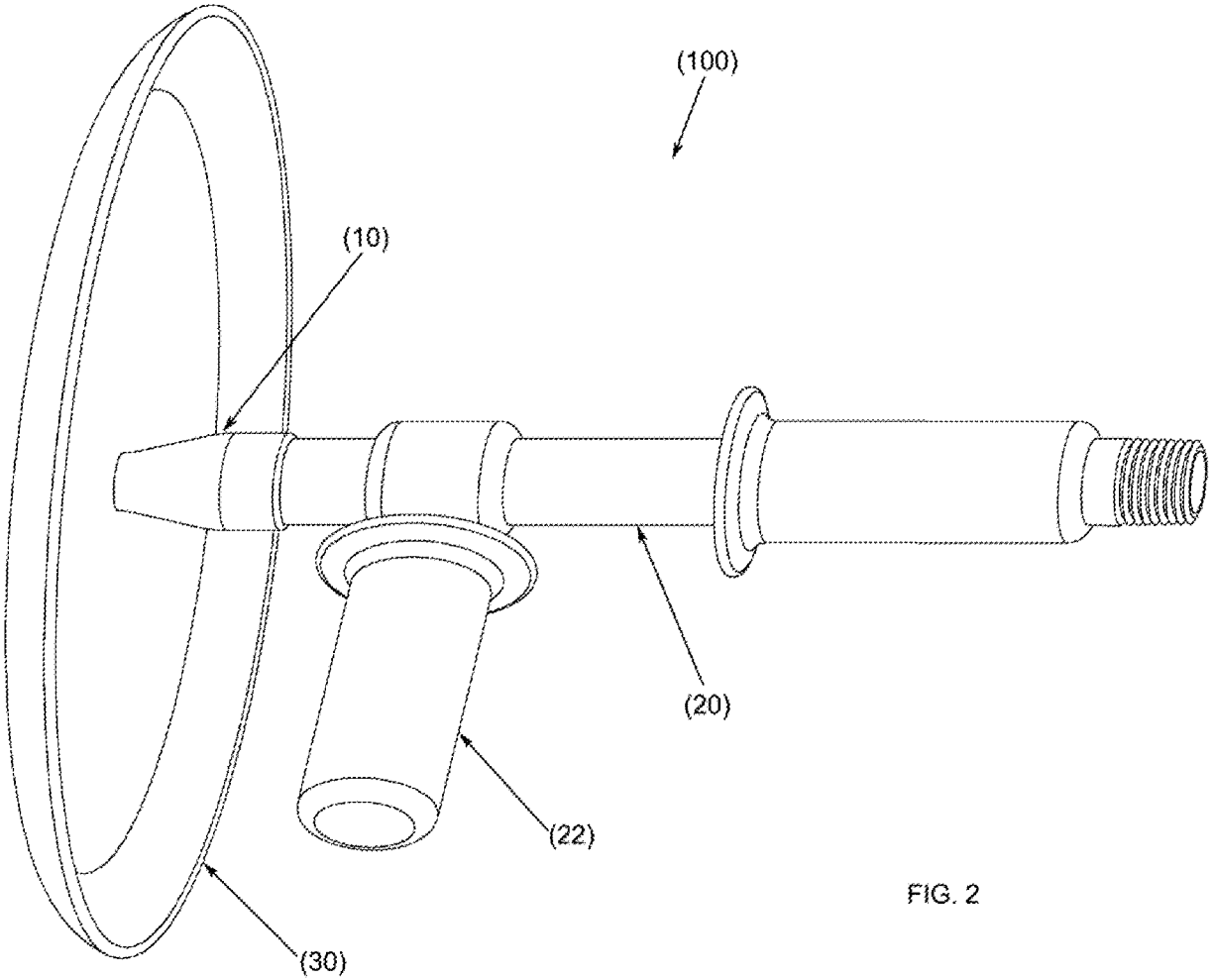
FIG. 2 is a perspective view of the injection tool according to a preferred embodiment of the invention.
Figure 3:
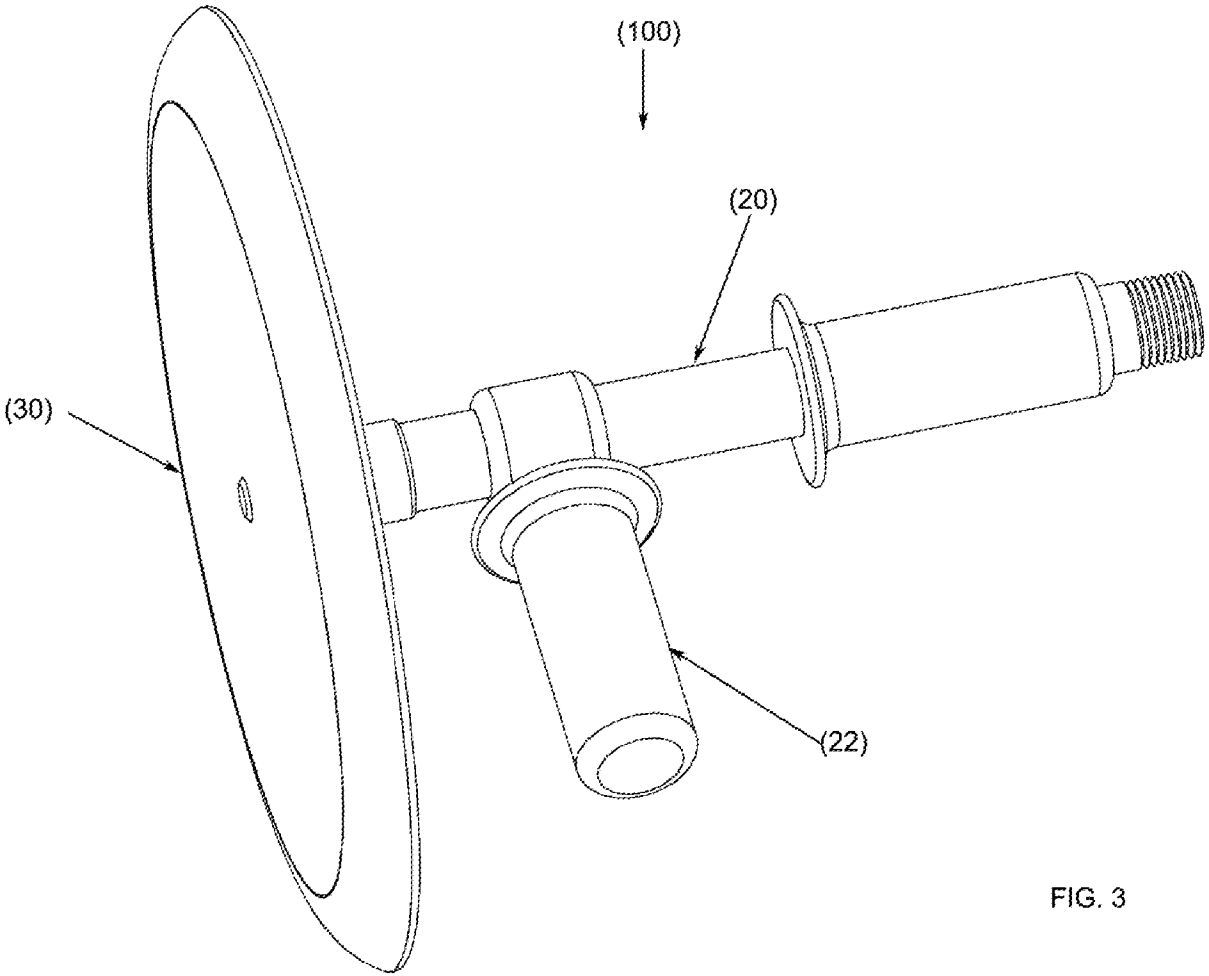
FIG. 3 is a second perspective view of the injection tool according to a preferred embodiment of the invention.
Figure 8:
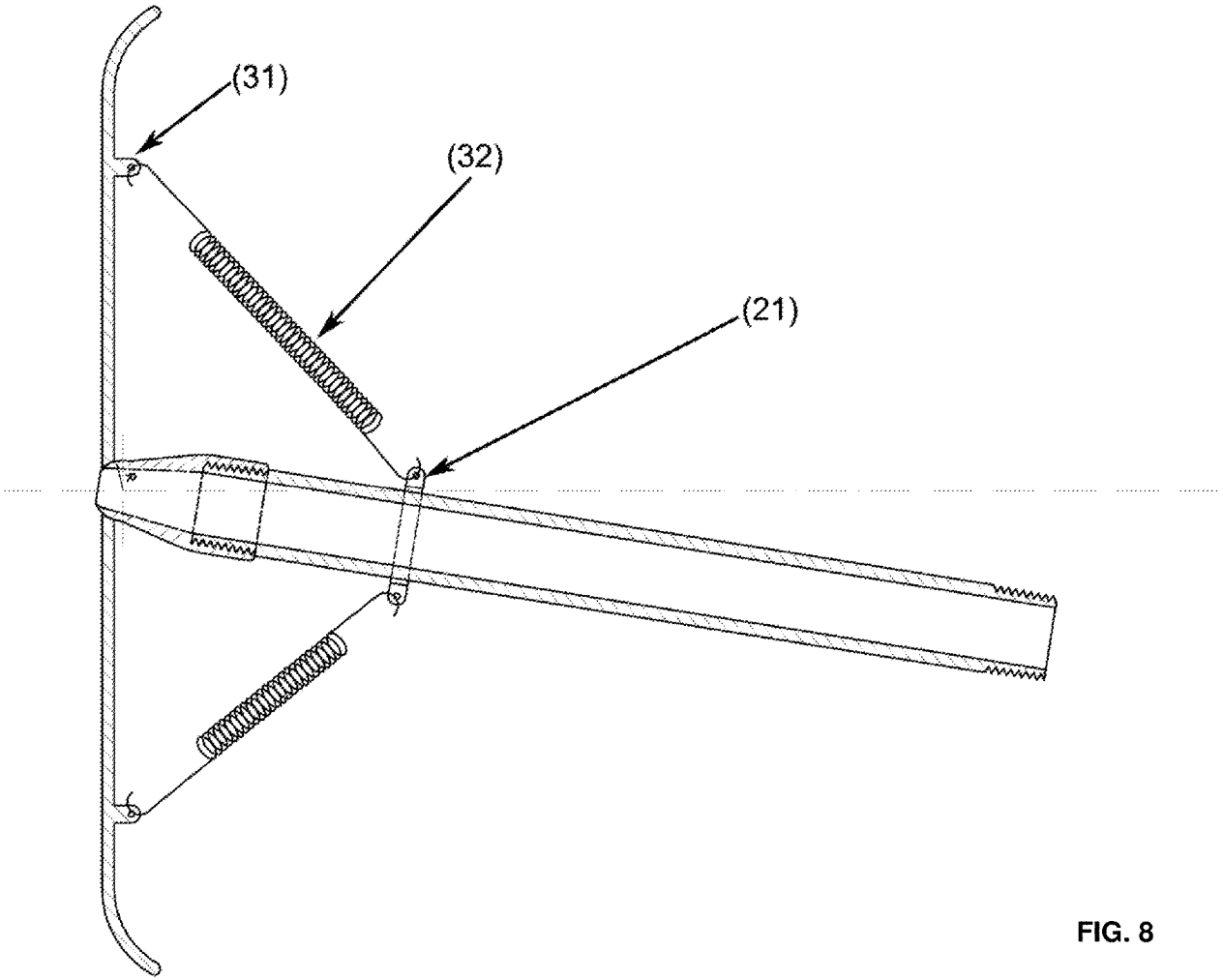
FIG. 8 is a side, cross-section view of the injecting tool with a system of springs according to another alternative embodiment of the present invention.

In the preferred embodiment of the invention and as shown in FIGS. 2 and 3, the nozzle (100) comprises:

An injector (10) with a tip of semi-spherical profile extended to a tapered section and ending in a tubular body, which end comprises a tubular connection means, preferably an internal thread, with said injector being fully hollow inside, and A tubular body (20) comprising in both ends a tubular connection means forwardly with the injector (10) and backwardly with a pumping system (600) of viscous fluid. In order to facilitate the handling of the tools when injecting the fluid, said tubular body (20) also comprises two handles or side-handles (22, 23), a handle (23) on the rear of and aligned with the tubular body (20), and a side-handle (22) close to the injector (10) and perpendicular to the tubular body (20), as seen in FIGS. 2, 3, 4 and 5. In addition, in an alternative embodiment of the nozzle, the tubular body (20) comprises connection means (21) for springs (32), distributed in an annular way close to the front end, as shown in FIG. 8.

Figure 4:
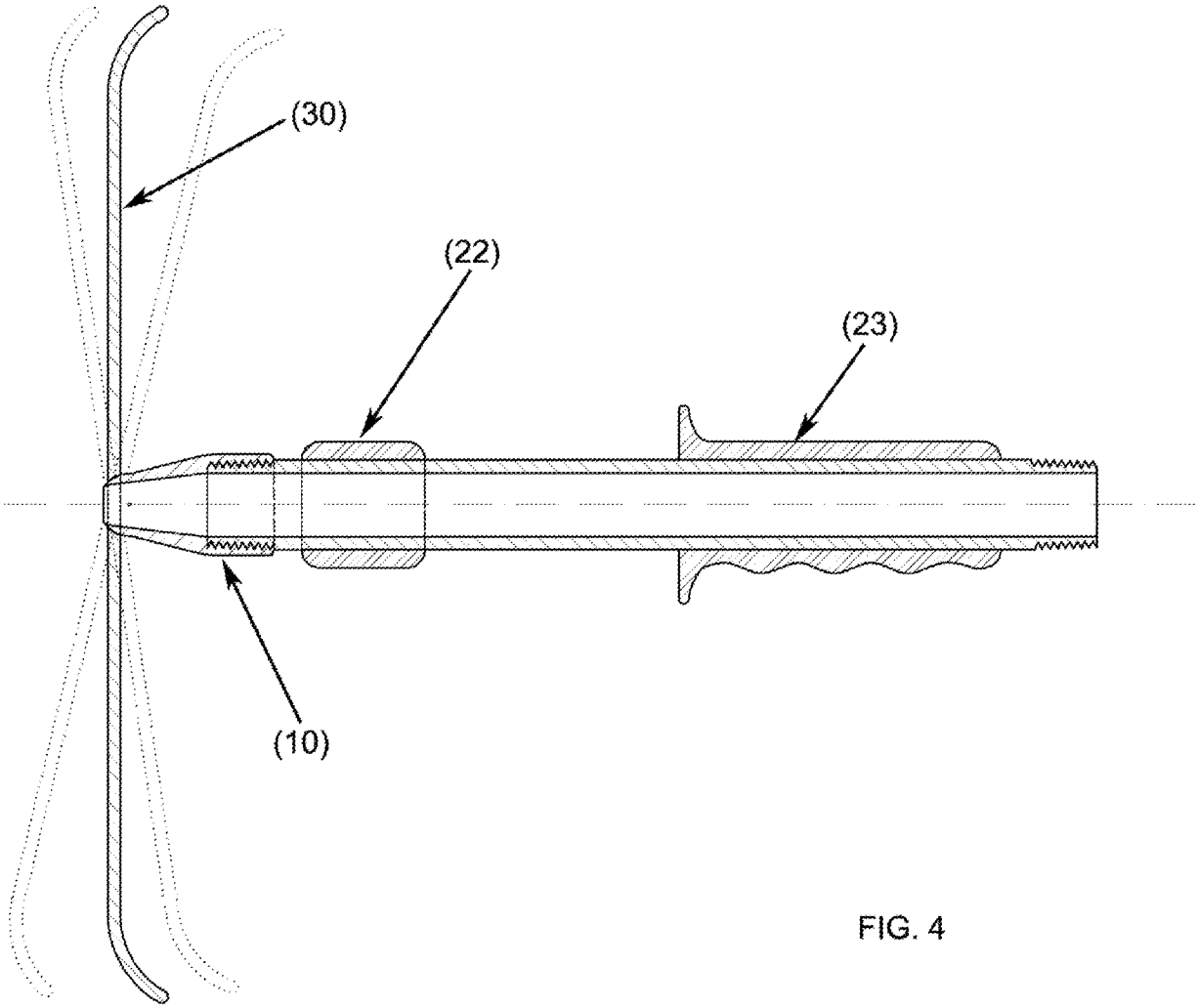
FIG. 4 is a vertical, longitudinal cross section of the injection tool according to a preferred embodiment of the invention, where the freedom of movement level is shown for the screen in relation to the injector.
Figure 5:
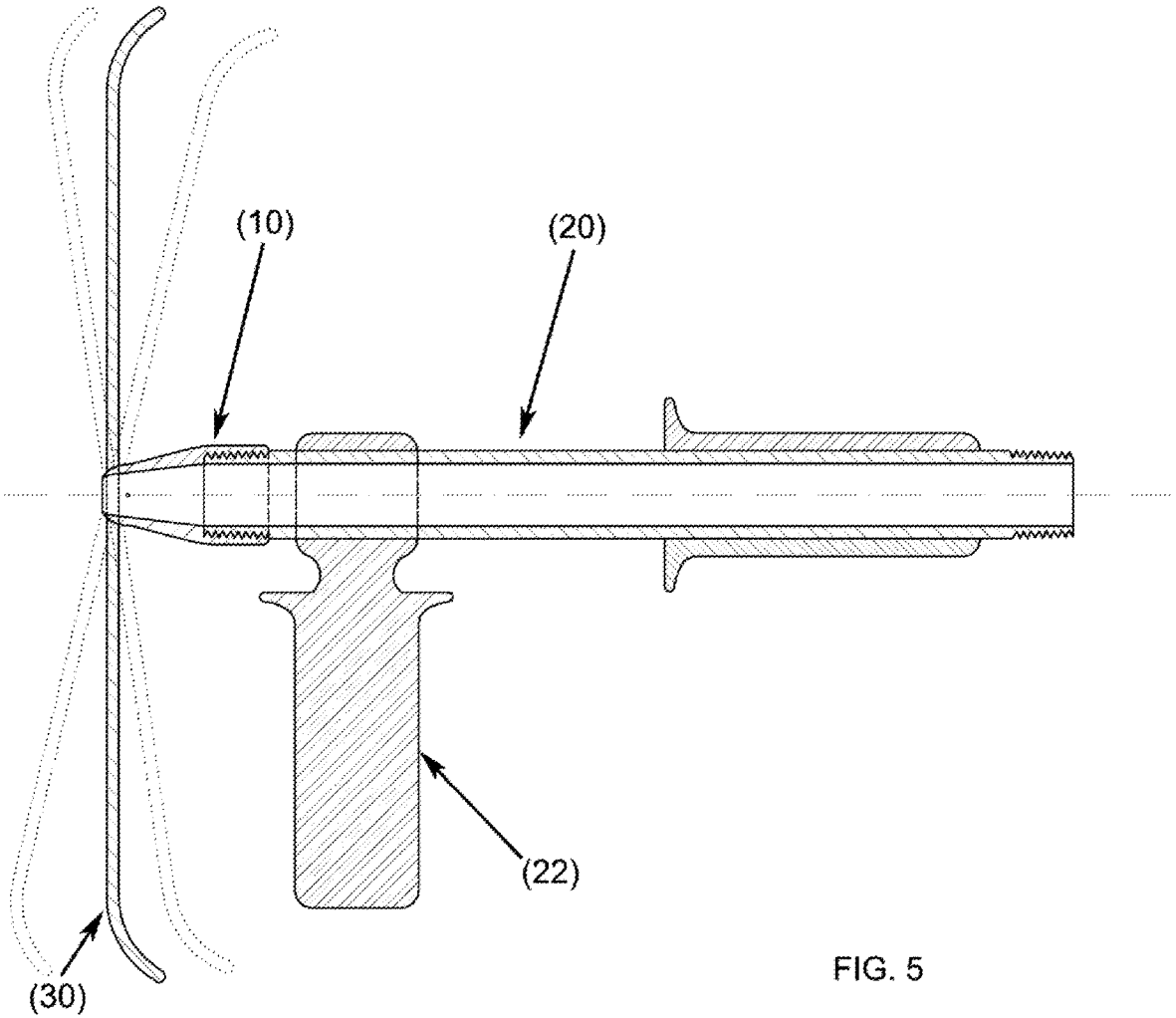
FIG. 5 is a horizontal, longitudinal cross section of the injection tool according to a preferred embodiment of the invention, where the freedom of movement level is shown for the screen in relation to the injector.
Figure 6:
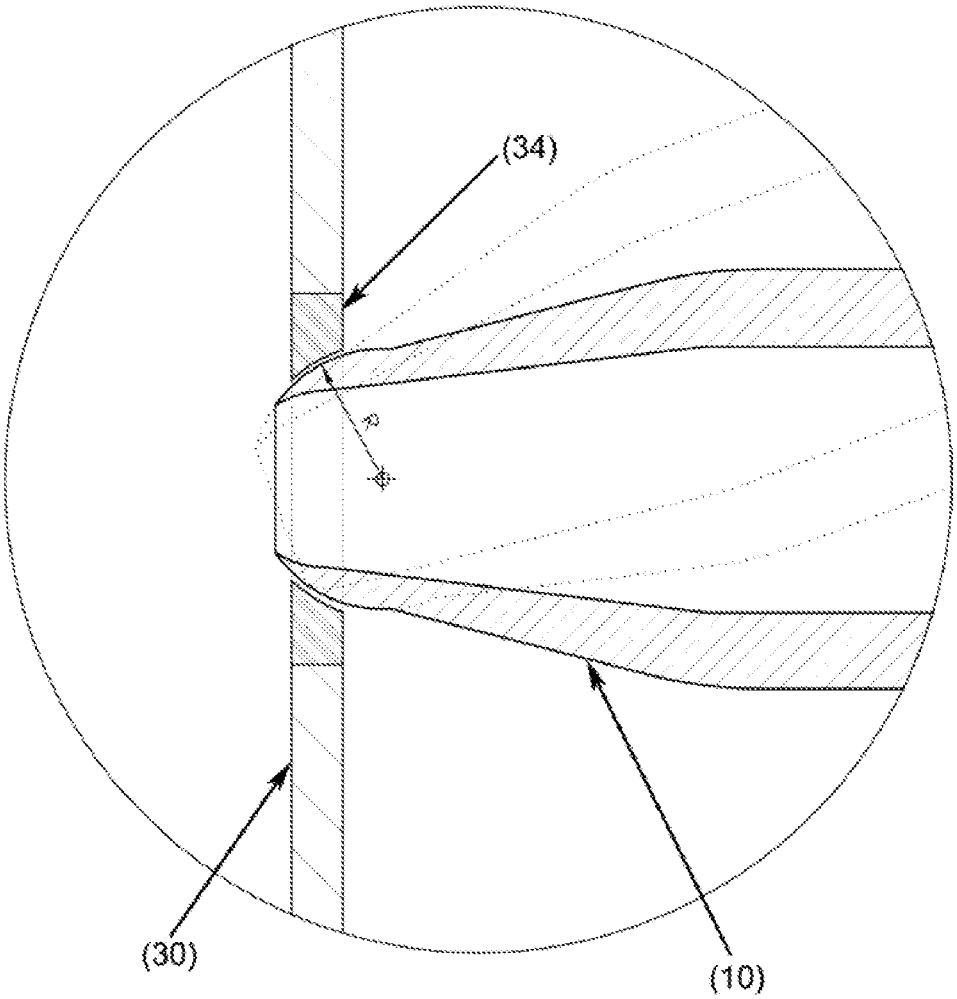
FIG. 6 is a side, cross-section view of the injector and of the screen, where the semi-spherical profile of both parts is shown and how this allows freedom of movement levels between the injector and the screen. It also shows a ring-shaped magnet surrounding the central boring of the screen that keeps it adhered to the screen according to the preferred embodiment of the nozzle.

The nozzle (100) also comprises as follows:

A screen (30) with a central boring of semi-spherical profile that complements with the tip profile of said injector, so that to allow the suspension and angular mobility of the screen over the injector, as shown in FIGS. 4, 5 and 6. The screen (30) is preferably transparent and with its external edge curved backwards, so that to facilitate the displacement of the assembly through the external surface of the groove to be injected.

The means of tubular connection of the injector (10) and the tubular body (20) correspond to each other, as shown in FIGS. 4 and 5. The connection means located inside the end of the injector (10) matches the connection means of the outside of the tubular (20). In a preferred assembly of the invention, the connection means are threads, but they are not limited to this kind of connection and said connection can be performed by any proper means.

As shown in detail in FIG. 6 and according to the preferred embodiment, the tip of the injector (10) of the nozzle (100) has a semi-spherical external profile, to which the screen (30) is coupled through a central boring with the same semi-spherical profile of the tip of the injector (10), so that to allow the suspension and the angular mobility of the screen over the injector; thus the nozzle may lose perpendicularity to the wall plane, while the screen (30) will remain fully in touch with the surface, preventing the injected fluid from spilling outside the groove or volume to fill.

Figure 7:
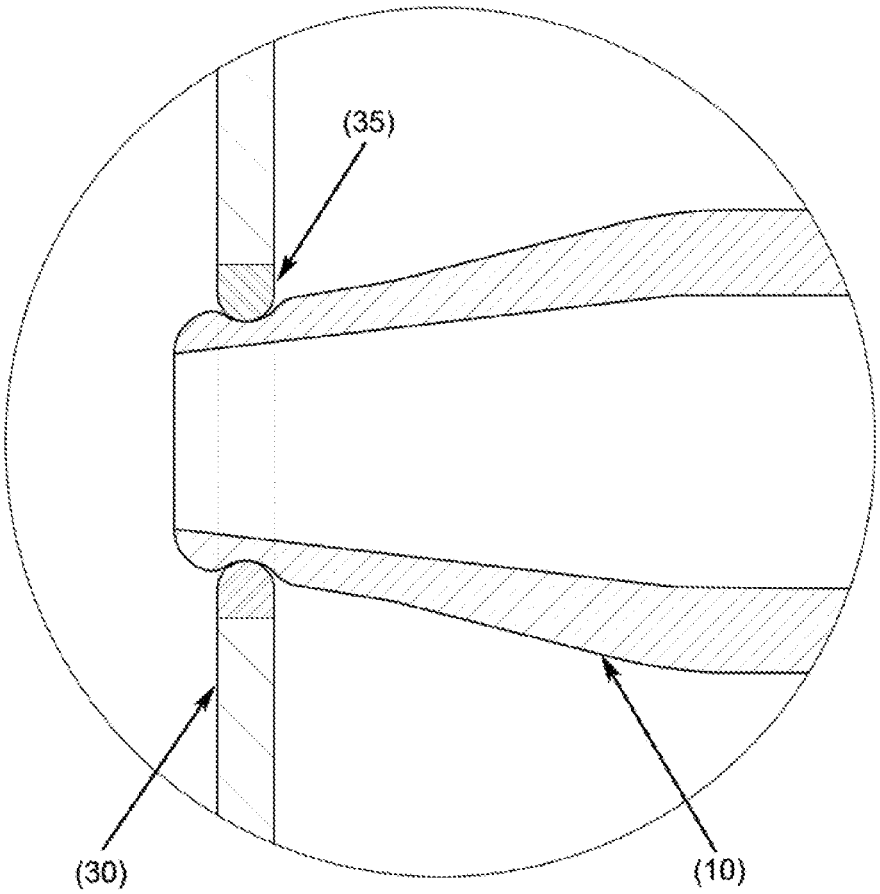
FIG. 7 is a side, cross-section view of the injector and of the screen, where a ring-shaped depression on the end of the injector where the screen is coupled, which central boring is surrounded by an elastic material according to an alternative embodiment of the present invention.

As it can be seen in FIGS. 6 and 7, the edge of the front end of the injector (10) of nozzle (100) slightly breaks through the screen (30) to act as guide in the displacement of grooves. The apparent radius of the screen should be equal to or greater than the groove or hole to fill, because with this the nozzle (100) forces the mortar (300) to penetrate a depth equal to the screen's apparent radius before starting to seep outside the groove and over the edge of the screen. It is also obvious that the pumping pressure and the mortar fluidity are key parameters to get the desired result in each particular case.

In order to keep the screen (30) adhered to the injector (10) in the preferred embodiment where the screen's central boring has a semi-spherical profile that complements the profile of the tip of said injector, the preferred adhesion embodiments—shown in FIG. 6—comprises a ring-shaped magnet (34), which internal profile complements that of the injector (10) and its external profile is joined with the contour of the central boring of the screen (30), keeping the screen 30 joined to the injector's metal tip, preferably ferrous. For this same configuration, an alternative adhesion embodiment, shown in FIG. 8, is going through a plurality of springs (32) engaged to connection means (21, 31) distributed over the screen (30) and in the tubular body (20) in a symmetric and concentric way.

In an alternative embodiment of the invention, shown in FIG. 7, the coupling and adhesion means between the screen (30) and the injector (10) comprises a rubber part in form of ring (35), which is joint in its outside to the contour of the central boring of the screen (30), while the inside part adjust to a ring-shaped depression in the end of the injector (10); thus, the screen remains joint to the injector, but with the levels of freedom required for the functionality foreseen in the present invention.

Figure 10:
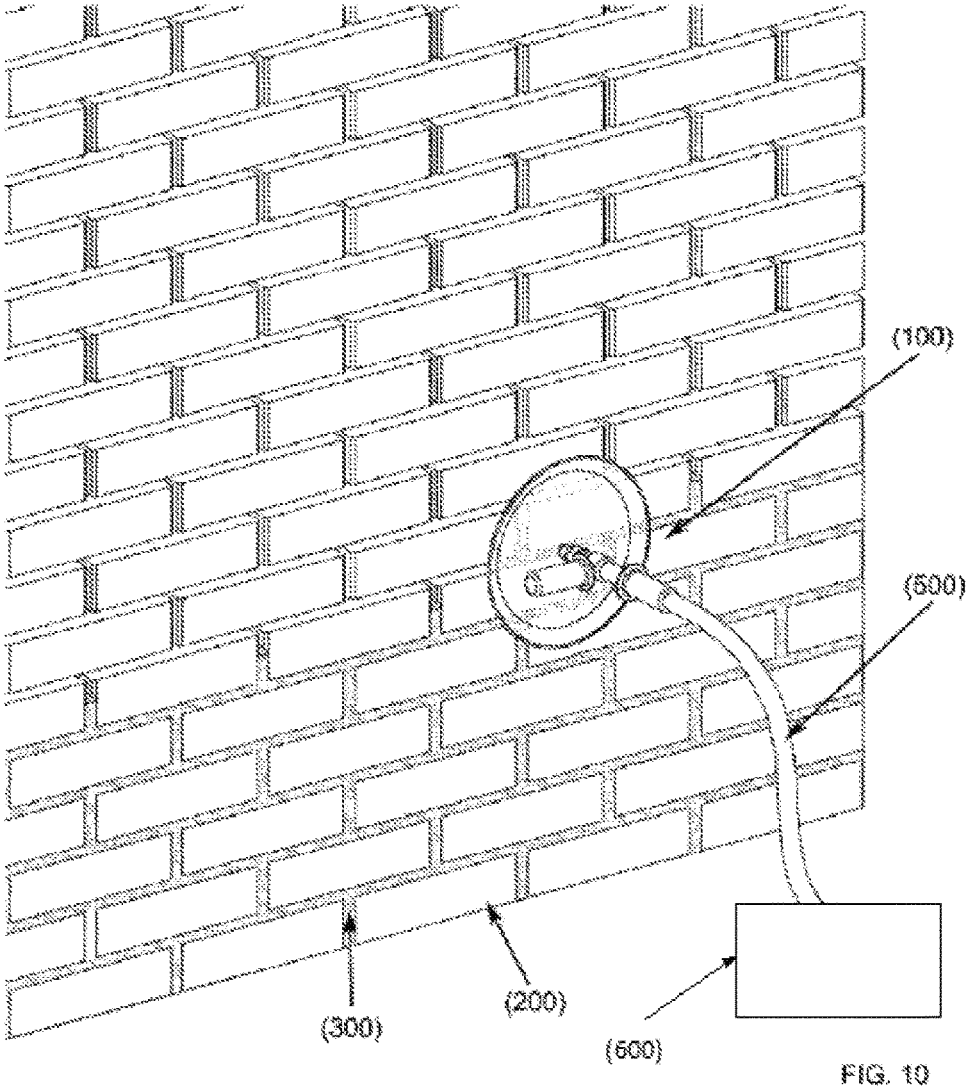
FIG. 10 is a perspective view of a masonry wall in the process of construction, where the sticking mortar is injected ex post using the tool connected to a pumping system and method of the present invention.

The preferred use of the nozzle (100), as shown by FIGS. 1 and 10, is in the injection of sticking mortar (300) among the masonry units, when the constructive method considered in this invention is used consisting in: pre-building the walls of the whole level of the house only with masonry units, preferably bricks (200) and any kind of separators or connectors (400) producing the proper spacing between the masonry units, in addition to fix the location of each unit in relation to the surrounding ones. This allows installing the pipe inside the wall, as well as fixing the door and window frames and then checking the risk location of all elements, injecting the sticking mortar (300) between the masonry units using the nozzle (100) connected to the mortar pumping machine through a flexible pipe (500). The injection process should start from the lowest rows and along a horizontal course, as shown by FIG. 1, because the vertical grooves are filled fast, when the nozzle goes through the horizontal rows. In walls built with hollow bricks, completing the injection by the other side of the wall is necessary.

The invention claimed is:

1. A device for the injection of viscous fluids in holes, cracks or grooves in masonry wall construction, the device comprising:

a tubular body which receives fluid to inject from one end, and in an opposite end has an injector nozzle with a tip;

a flat screen with a central boring, the flat screen comprising of a disk with an external edge that is rounded or curved backwards, the injector nozzle inserted through the central boring such that the tip of the injector nozzle projects over a front external surface of the flat screen, wherein said tip of the injector nozzle is coupled to the screen by a coupling that allows inclination of said flat screen with respect to the injector nozzle, which allows the flat screen to adjust to a surface of a wall with a small pressure on the device when over a groove in the wall, preventing the viscous fluid from draining out of said groove, and the tip of the injector nozzle includes a ring-shaped depression close to an end of the tip of the injector nozzle and an adjustment between the tip of the injector nozzle and the flat screen is through an elastomeric material.

2. The device for the injection of viscous fluids according to claim 1, wherein the end of the tip of the injector nozzle has a semi-spherical shape and is supplemented with the same semi-spherical form in the central boring of the flat screen.

3. The device for the injection of viscous fluids according to claim 2, wherein the tip of the injector nozzle is a ferrous tip, and the central boring of the flat screen is surrounded by one or more magnets that keep the flat screen adhered to the ferrous tip of the injector nozzle.

4. The device for the injection of viscous fluids according to claim 2, wherein the flat screen remains adhered to the tip of the injector nozzle through a plurality of springs that pull the flat screen from equidistant points from a center towards a ring located in the tubular body.

5. The device for the injection of viscous fluids according to claim 1, wherein the flat screen is made of transparent material.

6. The device for the injection of viscous fluids according to claim 5, wherein the transparent material is glass or polycarbonate.

7. The device for the injection of viscous fluids according to claim 1, further comprising:

a handle that is perpendicular to the tubular body.

8. The device for the injection of viscous fluids according to claim 1, further comprising:

a handle on a rear portion of the tubular body.

9. A method to build a masonry rig, the method comprising:

building a wall including masonry units, and separators or connectors, the separators or connectors providing proper spacing between the masonry units, and fix a position of each masonry unit with respect to the masonry units that surround said masonry unit, wherein spaces between the masonry units produce grooves;

supplying the device of claim 1 for the injection of viscous fluid in holes, cracks, or grooves;

connecting said device to a pump for the injection of viscous fluid;

injecting the viscous fluid between the masonry units by horizontally moving the injection nozzle of the device over a lower one of the grooves; and repeating the previous stage of injecting the mortar viscous fluid between masonry units multiple times, wherein each of the multiples times the injection nozzle is moved horizontally over a different one of the grooves that is upperly adjacent.

* * * * *